US008847069B2

(12) United States Patent
Emme

(10) Patent No.: US 8,847,069 B2
(45) Date of Patent: Sep. 30, 2014

(54) HIGH VOLTAGE ELECTRIC CABLE

(71) Applicant: Robert Emme, Karlskrona (SE)

(72) Inventor: Robert Emme, Karlskrona (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/912,951

(22) Filed: Jun. 7, 2013

(65) Prior Publication Data

US 2013/0269966 A1 Oct. 17, 2013

Related U.S. Application Data

(63) Continuation of application No. PCT/EP2010/069813, filed on Dec. 15, 2010.

(51) Int. Cl.
*H01B 7/42* (2006.01)
*H01B 9/00* (2006.01)

(52) U.S. Cl.
CPC . *H01B 7/423* (2013.01); *H01B 9/00* (2013.01)
USPC ..... 174/15.6; 174/15.1; 174/71 C; 174/47

(58) Field of Classification Search
CPC ..... H01B 7/428; H01B 9/0611; H01B 12/06; H01B 12/16
USPC ..... 174/15.1, 15.2, 15.4, 15.5, 17 LF, 17 GF, 174/19, 20, 21 R, 22 R, 22 C, 23 R, 24, 25 R, 174/26 G, 27–29, 110 R, 113 R, 113 C, 115, 174/116, 71 C, 47
See application file for complete search history.

(56) References Cited

U.S. PATENT DOCUMENTS

| | | | | | |
|---|---|---|---|---|---|
| 1,883,648 | A * | 10/1932 | Emanueli | 174/26 R |
| 3,170,026 | A * | 2/1965 | Woodson | 174/15.6 |
| 3,595,982 | A * | 7/1971 | Kafka | 174/15.5 |
| 3,603,718 | A * | 9/1971 | Gedenk | 174/47 |
| 3,749,811 | A * | 7/1973 | Bogner et al. | 174/15.5 |
| 3,924,054 | A * | 12/1975 | Falke | 174/15.6 |
| 6,012,495 | A * | 1/2000 | Antonsen | 138/131 |
| 2008/0164048 | A1 * | 7/2008 | Hirose | 174/15.5 |

FOREIGN PATENT DOCUMENTS

| | | | | |
|---|---|---|---|---|
| DE | 1640122 | U | 6/1952 | |
| EP | 0562331 | A2 | 9/1993 | |
| FR | 608155 | A | 7/1926 | |
| FR | 608155 | A * | 7/1926 | H01B 9/0611 |

(Continued)

OTHER PUBLICATIONS

International Preliminary Report on Patentability Application No. PCT/EP2010/069813 Completed: Feb. 4, 2013 15 pages.

(Continued)

*Primary Examiner* — Chau N Nguyen
*Assistant Examiner* — Paul McGee, III
(74) *Attorney, Agent, or Firm* — St. Onge Steward Johnston & Reens LLC

(57) ABSTRACT

A high voltage electric cable including a cable core, a cooling pipe for cooling the cable core including a polymer and adapted for carrying a cooling fluid, and a cable covering enclosing the cable core and the cooling pipe. The electric cable further includes a heat conducting element surrounding the cable core, and being arranged in thermal contact with the cable core and the cooling pipe.

17 Claims, 5 Drawing Sheets

(56) References Cited

FOREIGN PATENT DOCUMENTS

| | | | |
|---|---|---|---|
| GB | 875930 | A | 8/1962 |
| JP | S5051173 | U | 5/1975 |
| JP | S5456187 | A | 5/1979 |
| JP | S585907 | A | 1/1983 |
| JP | S63109522 | U | 7/1988 |

OTHER PUBLICATIONS

International Search Report and Written Opinion of the International Searching Authority Application No. PCT/EP2010/069813 Completed: Aug. 15, 2011; Mailing Date: Aug. 23, 2011 11 pages.

* cited by examiner

HIGH VOLTAGE ELECTRIC CABLE

FIELD OF THE INVENTION

The present invention relates to a high voltage electric cable with integrated cooling. The electric cable comprises at least one cable core and at least one cooling pipe for cooling the cable core.

"High voltage" refers to electric voltages of 10 kV and above, and is often much higher comprising, for example, hundreds of kV.

BACKGROUND OF THE INVENTION

The conductor of a high voltage electric power cable generates heat when transmitting electric power. This heat is transferred through the cable insulation arranged around the conductor and the temperature in the surrounding area of the cable is increased due to those heat losses. The conductor is, for example, made of copper or aluminum, and the electric insulation referred to herein may be polymeric and then typically comprises cross-linked polyethylene, or an oil impregnated paper insulation. The heat generated in the conductor may lead to deterioration of the insulation if the temperature of the conductor is not maintained within a defined interval. One way of keeping the temperature of the conductor in the defined interval is to increase the conductor area. However, this is not desirable as the material used in the conductor is expensive and also an increased amount of electric insulation material will be required with regard to the increased conductor area.

For electric power cables laid underground there are different ways to handle the heat losses generated when transmitting electric power in the cable. It is, for example, possible to embed, in the soil adjacent to the cables, a pipe through which a cooling liquid could pass to maintain the temperature of the soil. Another way is to enclose the cable, or cables, in a pipe or duct through which a cooling medium, for example, air or water, is circulated. The cooling medium extracts the additional heat generated by the conductor and thereby keeps the temperature of the cable within the permitted temperature limits.

Patent specification GB 875,930 discloses a cable where a plurality of ducts or pipes are provided for the circulation of a cooling liquid in an outer impermeable protective covering or sheath of plastic material enclosing the sheath surrounding the one or several cable cores. Heat generated in the conductor when the cable is transmitting electric power is dissipated by the cooling liquid circulated through the pipes and the temperature of the cable is maintained within the permitted temperature limits.

Patent abstract JP 54-056187 discloses a power cable comprising a metallic or plastic cooling pipe arranged in a gap between cable cores of the cable. Cooling air or water is arranged in the cooling pipe to absorb the heat generated in the conductor of the cable core.

Patent specification EP 0562331 discloses an electric cable comprising three cable cores with integrated cooling by at least one jointly stranded cooling element with at least one conveying hollow duct for forward and backward flow where at least one coolant conveying cable element is constructed in the form of a composite section made of aluminum and having an inner pipe of steel for holding a cooling medium.

SUMMARY OF THE INVENTION

An object of the invention is to provide a high voltage electric cable comprising an integrated cooling pipe that has improved or at least the same cooling characteristics compared to prior art cables comprising integrated cooling pipes, and that at the same time is cost-effective to manufacture.

According to a first aspect of the invention, those objects are achieved with a high voltage electric cable comprising at least one cable core, at least one cooling pipe for cooling the cable core, where the cooling pipe comprises a polymer and is adapted for carrying a cooling liquid. The electric cable further comprises a cable covering surrounding the at least one cable core and the at least one cooling pipe, wherein the electric cable comprises at least one heat conducting element surrounding the at least one cable core, and arranged in thermal contact with the at least one cable core and the at least one cooling pipe.

By arranging a heat conducting element in contact with the outer surface of the at least two cable cores, the heat is conducted from the cable cores to the cooling medium arranged in the cooling pipes in an efficient way. Also, the heat generated in the conductor of the cable core is thermally equalized in the cable core.

According to an embodiment of the invention the at least one heat conducting element is a first metallic layer. The first metallic layer is surrounding the cable core and is in thermal contact with the at least one cable core. By arranging a metallic layer in contact with the outer surface of the at least one cable core, the temperature profile around and through the insulation of the at least one cable core is equalized and heat is transferred from the conductor in the radial direction of the cable through the insulation and to the metallic layer surrounding the cable. Also, an efficient thermal transfer to the cooling pipe is ensured via conduction of the heat from the cable core in the same metallic layer. Depending on the earth bonding system of the cable, a minor, or a significant, amount of the total heat loss may also be generated in a cable screen that may be surrounding the at least one cable core and this heat will also be conducted to the first metallic layer.

According to an embodiment the first metallic layer is, for example, made of aluminum, copper or steel.

According to an embodiment of the invention the electric cable further comprises a heat conducting second metallic layer surrounding the at least one cooling pipe, and arranged in thermal contact with the at least one cooling pipe. Thereby the heat transfer through the walls of the cooling pipes will be equalized around the whole circumference of the cooling pipes, and an efficient heat transfer to the cooling liquid to be arranged in the cooling pipe is achieved.

According to an embodiment the second metallic layer is, for example, made of aluminum, copper or steel.

According to an embodiment of the invention the at least one cooling pipe is made of a flexible polymer pipe. By arranging a flexible polymer pipe as cooling pipe within the electric cable, the manufacture of an electric cable with integrated cooling pipe is facilitated. This is because a flexible polymer pipe can easily be integrated in the cable during the assembly of cable. "Flexible" means that the cooling pipe is sufficiently flexible to be twisted together with three cable cores during the manufacture of the cable.

According to an embodiment of the invention the at least one cooling pipe withstands overpressure. A pressure rating of at least 5 bars, preferably at least 10 bars, for the cooling pipe will make it feasible for cable installations of about 1-4 km with one cooling circuit only. The higher the pressure rating of the cooling pipe is the longer cooling circuits can be installed.

According to an embodiment of the invention the polymer in the cooling pipe is, for example, made of rubber, polytetrafluorethylene (PTFE), or medium density polyethylene (MDPE).

According to an embodiment of the invention the second metallic layer is a metal braid surrounding the at least one cooling pipe, and arranged in thermal contact with the at least one cooling pipe. The metal braiding is, for example, made of steel or aluminum. By using a metal braiding as the second metallic layer around the cooling pipe, the flexibility of the cooling pipe is facilitated and the pressure rating of the cooling pipe can be increased.

According to an embodiment of the invention the first metallic layer is a metal tape, or metal laminate, which is helically wound around the cable core or a metal tape, or laminate, which is folded around the cable core in an axial direction.

According to an embodiment of the invention the second metallic layer is a metal tape, or metal laminate, which is helically wound around the cable core or a metal tape, or laminate, which is folded around the cable core in an axial direction.

According to an embodiment of the invention the electric cable comprises three cable cores, each surrounded by a first metallic layer arranged in thermal contact with the cable core, and three cooling pipes arranged in the spaces formed between the three cable cores and the cable covering. The cooling pipes are in thermal contact with the first metallic layers. By this arrangement the cooling pipes can easily be integrated into the cable during the ordinary manufacture of a three-phase electric cable where the three cable cores are laid together and twisted. In an ordinary three-phase cable without liquid-cooling the interspaces are, for example, filled with fill profiles or filler ropes that are incorporated to the cable during the manufacturing such that a substantially circular shape of the outer surface profile is achieved. By the configuration according to this embodiment it is possible to obtain a compact three-phase cable with low external magnetic fields and minimize the use of copper or aluminum in the conductors of the cable cores. Also, as the diameter of a three-phase cable with integrated cooling will be substantially the same as for a three-phase cable without integrated cooling pipes, both the manufacture of the cable and the transportation of the electric cable will to a large extent be the same as for a cable without integrated cooling pipes.

According to an alternative embodiment the electric cable comprises three cable cores and a fourth cooling pipe arranged in the space formed between the three cable cores in the centre of the electric cable, and arranged in thermal contact with the first metallic layers. The three other cooling pipes are arranged as described in the previous embodiment in the spaces formed between the three cable cores and the cable covering surrounding the three cable cores. The cooling pipes can thereby easily be incorporated into the cable during the ordinary manufacturing of the electric cable.

According to an embodiment of the invention the electric cable comprises a heat conducting metallic sheath surrounding the at least one cable core and the at least one cooling pipe, and arranged in thermal contact with the heat conducting element and the cooling pipe. The metallic sheath is then arranged such that the temperature to be transferred to the surroundings and to the cooling pipe is equalized and that the thermal conduction from each cable part to both the surroundings and the cooling pipes is facilitated.

According to an embodiment of the invention the heat conducting metallic sheath is made of any of the following materials: copper, aluminum and steel.

According to an embodiment of the invention the first metallic layer has an average thickness in the interval of 0.01-3.0 mm, preferably in the interval of 0.1-1.5 mm. Thereby thermal performance and cost for the cable will be optimized. A thickness of the first metal layer in one of those intervals will provide a sufficient heat transfer, and at the same time it will be a suitable thickness to apply on a cable core with regard to manufacture and cost.

According to an embodiment of the invention the second metallic layer has an average thickness in the interval of 0.01-3.0, preferably in the interval of 0.1-1.5 mm. Thereby thermal performance and cost for the cable will be optimized. A thickness of the second metal layer in one of those intervals will provide a sufficient heat transfer, and at the same time it will be a suitable thickness to apply on a cooling pipe with regard to manufacturing and cost.

According to an embodiment of the invention the heat conducting metallic sheath has an average thickness in the interval of 0.01-3.0 mm, preferably in the interval of 0.1-1.5 mm.

According to an embodiment of the invention the first metallic layer and/or second metallic layer is made of aluminum and has an average thickness in the interval of 0.02-2.0 mm, preferably in the interval 0.2-0.6 mm to optimize thermal performance and cost. A thickness of the first or second metallic layer of aluminum in one of those intervals will provide an optimal heat transfer, and at the same time it will be a suitable thickness to apply on a cable core with regard to manufacturing and cost.

According to an embodiment of the invention the first metallic layer and/or the second metallic layer is made of copper and has an average thickness in the interval of 0.01-1.5 mm, preferably in the interval 0.1-0.3 mm to optimize thermal performance and cost. A thickness of the first or second metallic layer of copper in one of those intervals will provide an optimal heat transfer, and at the same time it will be a suitable thickness to apply on a cooling pipe with regard to the manufacturing and cost.

According to an embodiment of the invention the first metallic layer and/or second metallic layer is made of steel and has an average thickness in the interval of 0.1-3 mm, preferably in the interval of 0.7-1.5 mm.

According to one embodiment of the invention the heat conducting metallic sheath is made of aluminum and has an average thickness in the interval of 0.02-2.0 mm, preferably in the interval 0.2-0.6 mm to optimize thermal performance and cost for the heat conducting metallic sheath.

According to one embodiment of the invention the heat conducting metallic sheath is made of copper and has an average thickness in the interval of 0.01-1.5 mm, preferably in the interval 0.1-0.3 mm to optimize thermal performance and cost for the heat conducting metallic sheath.

According to one embodiment of the invention the heat conducting metallic sheath is made of steel and has an average thickness in the interval of 0.1-3 mm, preferably in the interval of 0.7-1.5 mm to optimize thermal performance and cost for the heat conducting metallic sheath.

According to an embodiment of the invention a heat conducting filler is arranged between the at least one cable core and the at least one cooling pipe. Thereby the transport of heat to the cooling pipes from the cable cores is further facilitated.

Another object of the present invention is to provide a cooling system for cooling a high voltage electric cable in order to achieve an effective cooling of the electric cable.

This object is achieved by a cooling system for a high voltage electric cable. The cooling system comprises a high voltage electric cable, and where the cable comprises at least two integrated cooling pipes carrying a cooling liquid, and where one of the at least two integrated cooling pipes is used for the return of the cooling liquid. According to one embodiment of the cooling system, heat from the cooling liquid is taken out at both ends of an installed cable to achieve an efficient cooling of long cable installations.

According to an alternative embodiment the cooling system comprises a high voltage electric cable having at least one integrated cooling pipe comprising a cooling liquid, and the cooling pipe is connected to a return pipe for the cooling liquid, and the return pipe is arranged separately from the electric cable.

The return pipe may be arranged to convey a cooling liquid in a cooling circuit. The heat losses from the cable are handled by an external cooling and circulation system for the liquid.

According to one embodiment of the cooling system the cooling liquid is water. When necessary, due to a risk of a surrounding temperature below 0° C., an anti-freezing solution, such ethylene glycol or ethanol, could be added to the water.

One advantage with the invention is that it will be easy to integrate the cooling pipes into the cable with only small modifications of a process for manufacturing the cable compared to the process for manufacturing a cable without integrated cooling pipes. The result will be a compact cable installation compared to many of the prior art cable cooling systems.

The use of integrated cooling in a cable can either make higher current ratings possible or save copper or aluminum in the conductor. It can also save the total dimension of the cable and the installation. The effect of saving copper or aluminum in the conductor will be especially good for high current ratings, requiring large, or very large, conductors, in normal installations or specifically in installations with low heat transport from the cable to the surrounding. A specific advantage is that a major part of the inefficient use of conductor metal, from the skin effect, when using large or very large conductors, may be avoided by the efficient cooling of the integrated cooling circuit and the use of smaller conductors than otherwise.

BRIEF DESCRIPTION OF THE DRAWINGS

The invention will now be explained more closely by description of different embodiments with reference to the accompanying drawing, wherein.

DETAILED DESCRIPTION OF THE INVENTION

Figure 1:
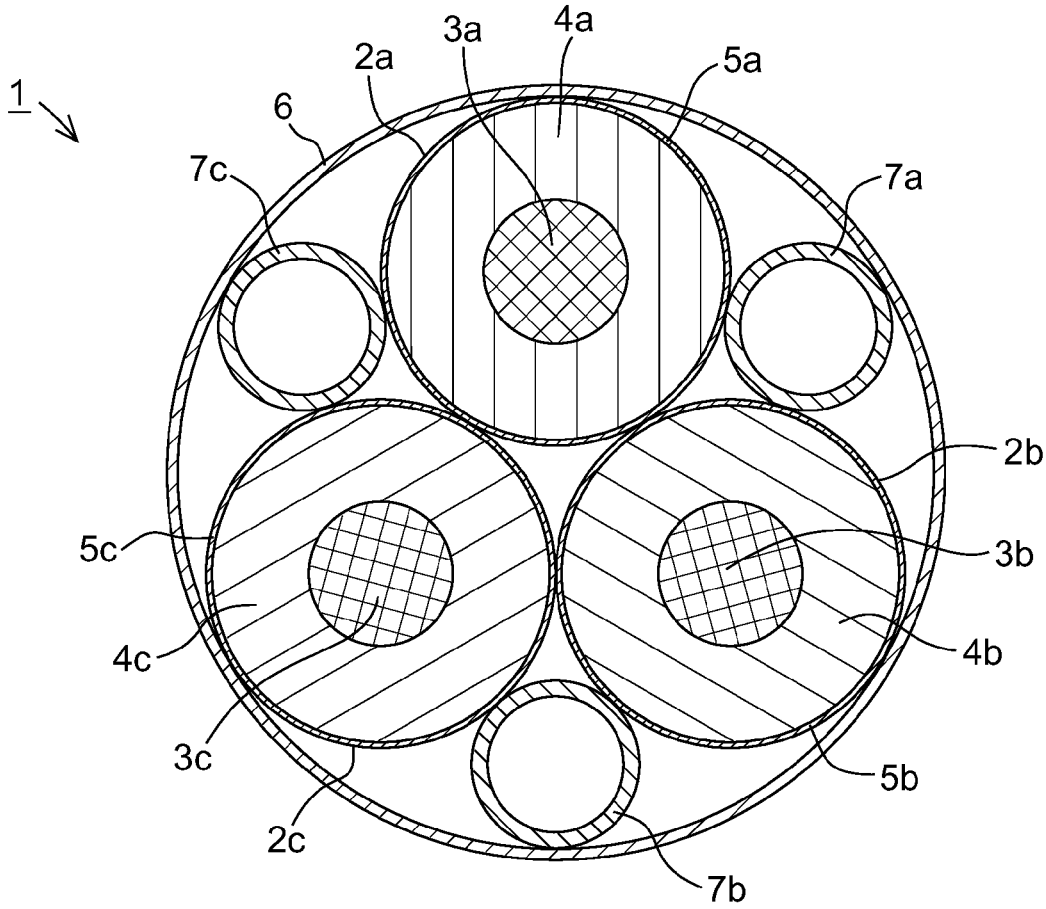
FIG. 1 is a cross-section of a three-phase electric cable according to a first embodiment of the present invention.

FIG. 1 shows an exemplary embodiment of the invention, and is a cross-section of a three-phase electric cable 1 where each cable core 2*a*, 2*b*, 2*c* comprises a conductor 3*a*, 3*b*, 3*c* surrounded by an electric insulation system 4*a*, 4*b*, 4*c*. The insulation system is surrounded by a heat conducting metallic layer 5*a*, 5*b*, 5*c* that is arranged in thermal contact with the outer surface of the insulation system 4*a*, 4*b*, 4*c* so that the heat generated by the conductor is transferred in the radial direction through the insulation system and out to the metallic layer 5*a*, 5*b*, 5*c*. Three cooling pipes 7*a*, 7*b*, 7*c* are provided in the interspaces formed between the three cable cores 2*a*, 2*b*, 2*c* and a cable covering 6 surrounding the three cable cores and the three cooling pipes. According to this embodiment, the cooling pipes are made of a polymer. The heat generated in the cable conductors 3*a*, 3*b*, 3*c* is transferred through the insulation system 4*a*, 4*b*, 4*c* and to the first metallic layer surrounding the insulation system, thereby equalizing the temperature profile in, and through, the electric insulation and the heat is conducted with low thermal resistance in the metallic layers 5*a*, 5*b*, 5*c* to the cooling pipes 7*a*, 7*b*, 7*c*.

Usually the interspaces in the cable are filled with fill profiles or filler ropes that are incorporated into the cable during the manufacture such that the outer surface profile of the cable covering becomes substantially circular. According to the exemplary embodiment shown in FIG. 5, fill profiles 11*a*, 11*b*, 11*c* may be arranged in the space formed between a cable core 2*a*, 2*b*, 2*c* a cooling pipe 7*a*, 7*b*, 7*c* and the cable covering 6. Those fill profiles may of course also be arranged in an electric cable according to any of the other embodiments.

Figure 2:
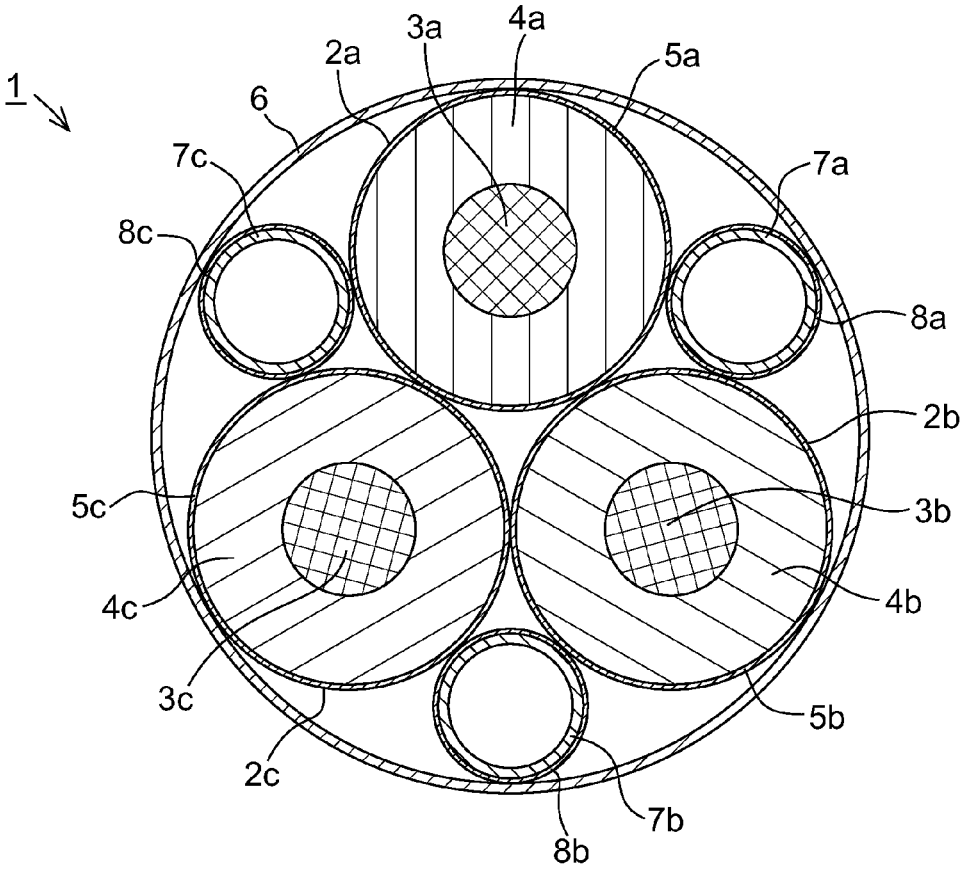
FIG. 2 is a cross-section of a three-phase electric cable according to a second embodiment of the invention.

FIG. 2 is a cross-section of a second embodiment of the invention, the difference with respect to FIG. 1 being that polymeric cooling pipes are provided with a second thermally conducting metallic layer 8*a*, 8*b*, 8*c*. The second metallic layer is arranged in thermal contact with the first metal layer 5*a*, 5*b*, 5*c* surrounding the cable cores 2*a*, 2*b*, 2*c* to efficiently conduct heat to the cooling liquid to be arranged in the cooling pipes 7*a*, 7*b*, 7*c*. The metallic layers 8*a*, 8*b*, 8*c* spread the heat transfer through the polymer cooling pipes almost equally around the entire circumference of the pipes, thereby significantly decreasing the thermal resistance for the heat flow to the cooling liquids, compared to the case when cooling pipes without the metallic layers are used.

Figure 3:
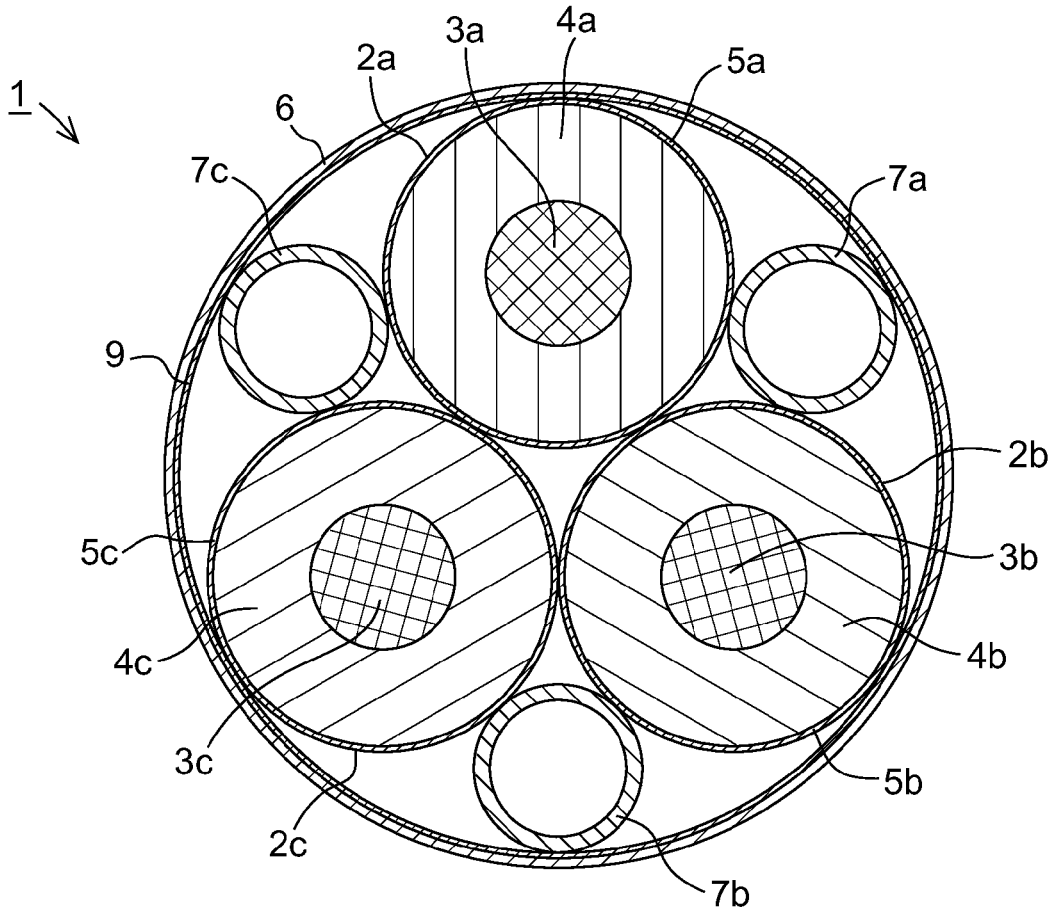
FIG. 3 is a cross section of a three-phase electric cable according to a third embodiment of the invention.

FIG. 3 is a cross-section of a third exemplary embodiment of the invention, the difference with respect to FIG. 1 being that a heat conducting metallic sheath 9 is surrounding the cable cores 2*a*, 2*b*, 2*c* and the cooling pipes 7*a*, 7*b*, 7*c* is arranged in thermal contact with the first metallic layers 5*a*, 5*b*, 5*c* and the cooling pipes 7*a*, 7*b*, 7*c*.

Figure 4:
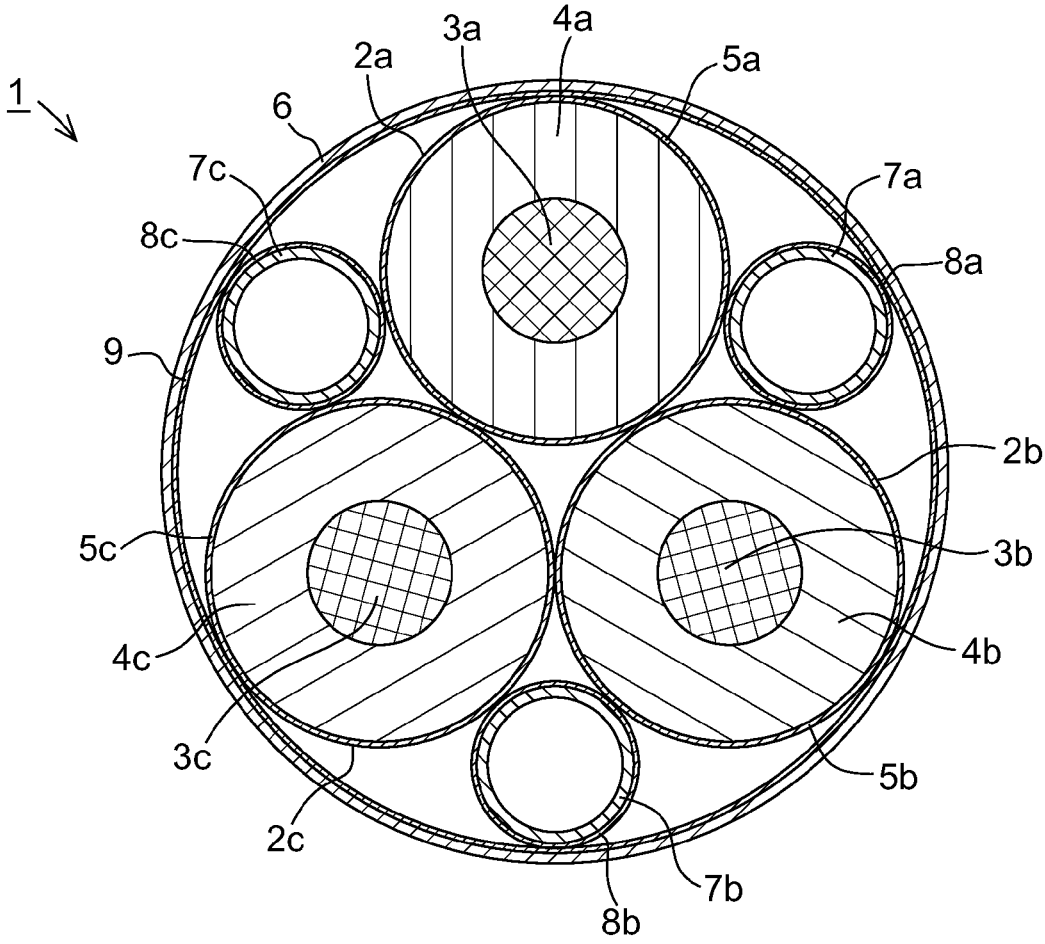
FIG. 4 is a cross section of a three-phase electric cable according to a fourth embodiment of the invention.

FIG. 4 is a cross-section of a fourth exemplary embodiment of the invention, the difference with respect to FIG. 2 being that a heat conducting metallic sheath 9 is surrounding the cable cores 2*a*, 2*b*, 2*c* and the cooling pipes 7*a*, 7*b*, 7*c* and is arranged in thermal contact with the first metallic layers 5*a*, 5*b*, 5*c* and second metallic layers 8*a*, 8*b*, 8*c*.

Figure 5:
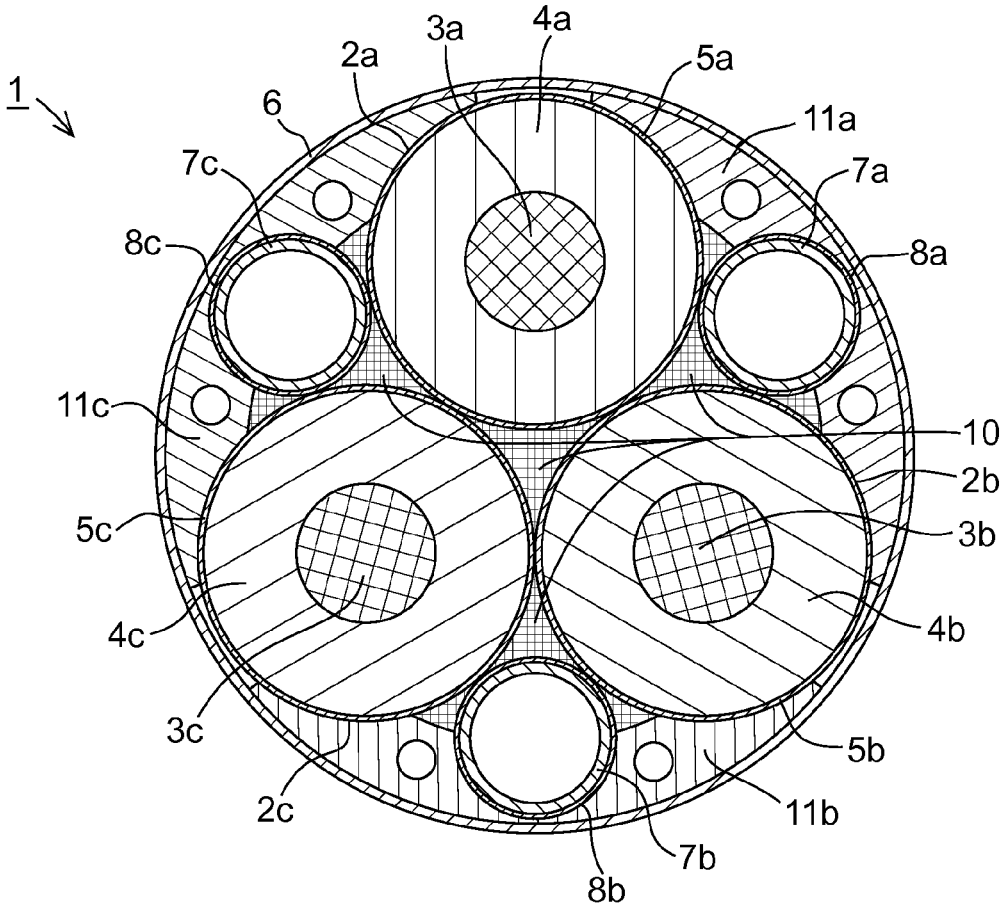
FIG. 5 is a cross section of a three-phase electric cable according to a fifth embodiment of the invention.

FIG. 5 is a cross-section of a fifth exemplary embodiment of the invention, the difference with respect to the embodiment in FIG. 2 being that a heat conducting filling compound 10 is arranged between the cable cores 2*a*, 2*b*, 2*c* and the cooling pipes 7*a*, 7*b*, 7*c*. The filling compound 10 is, for example, thermal grease, also called thermal paste, thermal gel or heat paste. Thermal grease usually comprises silicone, or a mineral oil, and particles with high thermal conductivity. The particles may for example be ceramics, such as beryllium oxide, aluminum nitrate, alumina or zinc oxide, or particles of metal such as aluminum, copper, or silver. An alternative to the filling compound may be to use some other type of thermally conducting device, such as a gasket, between a cable core and a cooling pipe to ensure that a sufficient thermal contact is maintained. The filler profiles 11*a*, 11*b*, 11*c* provide a circular shape of the cable and prevent indentations in the cable surface due to an empty space between the cable cores and the cooling pipes. The filler profiles are, for example, made of polyethylene and may be combined with the use of a filling compound in the inner interstices of the cable, as shown in FIG. 5.

The filler profiles 11*a*, 11*b*, 11*c* and the heat conducting compound 10 can be part of any of the cable designs illustrated in any of FIGS. 1-4.

The cooling pipes are incorporated into the electric cable during the ordinary manufacture of the electric cable, where the three cable cores are laid-up and twisted. At the position where the heat conducting layer surrounding the cable part has contact with the cooling pipes, it is important to have good thermal contact to facilitate the heat transfer to the cooling liquid. According to another exemplary embodiment the thermal contact between the cable cores and the cooling pipes is achieved by applying a pressure on the cooling pipes from the outside of the electric cable, such that they are pressed against the cable parts. This is, for example, achieved by the cable covering 6 holding the cable cores and cooling pipes together. The cable covering can be made of an extruded layer or of a polymeric or metallic tape. There may be additional layers (not shown) surrounding the cable core and cooling pipe and arranged outside or inside the cable covering. Those layers may, for example, be armoring, shields or bedding for the armoring.

The first metal layer 5*a*, 5*b*, 5*c* is, for example, made of aluminum or copper and may, for example, be a metal tape or metal laminate that is helically wound around the cable core, or a metal tape or metal laminate that is folded around the cable core in an longitudinal direction of the cable. According to an alternative embodiment the metal layer arranged around the cable core could be a layer of woven metal wires (braid), where the metal is, for example, aluminum, copper or steel.

The second metal layer 8*a*, 8*b*, 8*c* is, for example, made of aluminum or copper and may, for example, be a metal tape or metal laminate that is helically wound around the cooling pipe, or a metal tape or metal laminate that is folded around the cooling pipe in an longitudinal direction of the cable. According to an alternative embodiment the metal layer arranged around the cooling pipe could be a layer of woven metal wires (braid), where the metal is, for example, aluminum, copper or steel.

According to an exemplary embodiment of the invention a return pipe for the liquid cooling medium is arranged separately from the electric cable. Thermal insulation is preferably arranged between the return pipe and the power cable to prevent heat from the return pipe to heat the cable and the forward cooling liquid in the integrated cooling pipes of the cable.

In the following an example of the improvement of the cooling properties for a three-phase cable with three cable parts and three cooling pipes according to the embodiment described in connection to FIG. 2, i.e. where a metal layer is arranged around both the respective cable parts and cooling pipes, compared to a cable without the metal layers, will be described. In this example, the respective cable core has a conductor area that is 1520 $mm^2$, and an insulation system comprising an inner conducting layer and an outer conducting layer that is 26 mm thick. The three-phase cable was calculated as buried in soil of 25° C. undisturbed ambient temperature at the burial depth, and the cable screen was assumed to be single point bonded with the major part of the heat losses in the conductors. The conductor current capacity of the three-phase cable under these conditions and without any cooling system was calculated at 1330 ampere (A). The cooling liquid is water and the transmitted current is 1720 ampere (A). For a three-phase cable comprising integrated cooling pipes but without any heat-conducting metal layers, the temperature of the water at the place where the cooling circuit leaves the cable may not exceed 23.5° C. to transmit 1720 A. This requires that the temperature of the incoming water to the integrated cooling pipes of the cable should be well below 23.5° C. At an incoming water temperature of 15° C., a cable length corresponding to a ΔT of 8.5° C. and a certain flow rate could be cooled with one cooling circuit only, without heat conducting metal layers arranged around the cable parts or cooling pipes. For the embodiments described in connection with FIG. 2, i.e. with a metal layer arranged around both the respective cable parts and cooling pipes, the water at the place where the cooling circuit leaves the cable may not exceed 50° C. to transmit 1720 A. This means that at an incoming water temperature of 15° C., a cable length corresponding to a ΔT of 35° C. and a certain flow rate could be cooled with one cooling circuit only, when heat conducting metal layers are arranged around both the cable parts and cooling pipes.

This means that, for an electric power cable according to the above embodiment, described in connection to FIG. 2, a cable installation with a length that is about four times the length of an electric power cable with integrated cooling pipes, but without a heat conducting metal layer, can be installed with one cooling circuit only to transmit the same amount of current, if the cooling liquid flow rate is the same in both cases.

For the exemplary embodiment according to FIG. 1, i.e. where a heat conducting metal layer is arranged around each cable core, the maximum temperature of the water at the place where the cooling circuit leaves the cable may not be more than 40° C. When the incoming water temperature is 15° C. this gives a ΔT of 25° C. between the water entering the integrated cooling system and the water leaving the integrated cooling system of the cable. This makes it possible to install, with one cooling circuit only, an electric power cable with a length that is about three times the length of an electric power cable with integrated cooling pipes, but without a heat conducting metal layer, to transmit the same amount of current, if the cooling liquid flow rate is the same in both cases.

According to one exemplary embodiment of the invention, not shown in the drawings, there is provided an electric cable with one cable core comprising a conductor surrounded by an electric insulation system and one cooling pipe for cooling the cable. The cooling pipe comprises a polymer and is adapted for carrying a cooling liquid. The insulation system of the cable core is surrounded by a heat conducting layer of metal that is arranged in thermal contact with the outer surface of the cable core so that the heat generated by the conductor and transferred through the insulation system is equalized in and through the electric insulation. The metal layer is arranged in thermal contact with the cooling pipe to conduct the heat losses from the cable core to the cooling pipe with low thermal resistance.

The material of the insulation system in the above described embodiments is usually cross-linked polyethylene and comprises an inner conducting layer (not shown), an insulation layer, and an outer conducting layer (not shown). However, it should be understood that the insulation system could instead be an oil-impregnated paper insulation system.

Not shown in any of the embodiments is that there is normally a cable screen in contact with the first heat conducting metallic layer. A normal cable screen cannot replace the heat conducting first metallic layer 5*a*, 5*b*, 5*c*, if the individual wires of the screen are not in direct contact with each other everywhere around the entire circumference of the cable core. On top of the cable screen is often a cable core polymeric sheath, for example, polyethylene, arranged around each cable core, i.e. between the insulation system and the first metallic heat conducting layer. The cable covering 6 shown in FIGS. 1-5 may be a polymeric covering, for example polyethylene, or a metallic covering provided around the twisted cable cores and cooling pipes. The cable covering may be extruded or wound of a polymeric or metallic tape. The cable covering does not need to be continuous applied around the whole cable surface, but could be a tape that is, for example, helically wound around the cable cores and cooling pipes to keep them together.

Other layers that may be included in a cable design are, for example, swelling tapes and beddings under, and/or above, the cable covering, and a synthetic tape to fixate a three-phase cable after assembly of the three phases.

The invention is not limited to the embodiments shown above, but the person skilled in the art may, of course, modify them in a plurality of ways within the scope of the invention as defined by the claims. Thus, the invention is not limited to the case where the first metallic layer arranged around the cable core is the outermost layer of the cable cores, as there might be a thin insulating layer surrounding the cable core and arranged outside and in contact with the first metallic layer due to mechanical or manufacturing reasons. The metallic layers around the cable cores, or around both the cable cores and the cooling pipes at the same time, decrease the thermal resistance between the sources of the cable heat losses and the cooling liquid in integrated cooling pipes of the cable design. The different metallic layers can be used together in any combination.

What is claimed is:

1. A high voltage electric cable comprising:

at least one cable core, at least one cooling pipe for cooling the cable core, where the at least one cooling pipe comprises a polymer and is adapted for carrying a cooling liquid, and a cable covering surrounding the at least one cable core and the at least one cooling pipe, wherein the electric cable comprises at least one heat conducting element surrounding the at least one cable core, and arranged in thermal contact with the at least one cable core and the at least one cooling pipe, wherein the at least one heat conducting element is a heat conducting first metallic layer, and wherein the electric cable further comprises a heat conducting second metallic layer surrounding the at least one cooling pipe, and arranged in thermal contact with the at least one cooling pipe and the first metallic layer;

wherein the at least one cooling pipe is a flexible polymer pipe.

2. The high voltage electric cable according to claim 1, wherein the second metallic layer is a metal braid.

3. The high voltage electric cable according to claim 1, wherein the first or second metallic layer is a metal laminate or metal tape.

4. The high voltage electric cable according to claim 1, wherein the cable comprises:

three cable cores, each surrounded by a first metallic layer arranged in thermal contact with the cable core, and three cooling pipes arranged in the spaces formed between the three cable cores and the cable covering and in thermal contact with the first metallic layers.

5. The high voltage electric cable according to claim 4, wherein the cable comprises a fourth cooling pipe arranged in the space formed between the three cable cores in the centre of the electric cable, and arranged in thermal contact with the first metallic layers.

6. The high voltage electric cable according to claim 1, wherein the electric cable comprises a heat conducting metallic sheath surrounding the at least one cable core and the at least one cooling pipe, and arranged in thermal contact with the heat conducting element and the cooling pipe.

7. The high voltage electric cable according to claim 1, wherein the first metallic layer has an average thickness in the interval of 0.01-3.0 mm.

8. The high voltage electric cable according to claim 1, wherein the second metallic layer has an average thickness in the interval of 0.01-3.0 mm.

9. The high voltage electric cable according to claim 6, wherein the heat conducting metallic sheath has an average thickness in the interval of 0.01-3.0 mm.

10. The high voltage electric cable according to claim 1, wherein the first metallic layer or the second metallic layer is made of aluminum and has an average thickness in the interval of 0.02-2.0 mm.

11. The high voltage electric cable according to claim 1, wherein the first metallic layer or the second metallic layer is made of copper and has an average thickness in the interval of 0.01-1.5 mm.

12. The high voltage electric cable according to claim 1, wherein a heat conducting filler is arranged between the at least one cable core and the at least one cooling pipe.

13. A cooling system comprising a high voltage electric cable according to claim 1, wherein the cable comprises at least two integrated cooling pipes carrying a cooling liquid, and where one of the integrated cooling pipes is used for the return of the cooling liquid.

14. The high voltage electric cable according to claim 1, wherein the first metallic layer and the second metallic layer is made of aluminum and has an average thickness in the interval of 0.02-2.0 mm.

15. The high voltage electric cable according to claim 1, wherein the first metallic layer and the second metallic layer is made of copper and has an average thickness in the interval of 0.01-1.5 mm.

16. A high voltage electric cable comprising:

at least one cable core, at least one cooling pipe for cooling the cable core, where the at least one cooling pipe comprises a polymer and is adapted for carrying a cooling liquid, and a cable covering surrounding the at least one cable core and the at least one cooling pipe, wherein the electric cable comprises at least one heat conducting element surrounding the at least one cable core, and arranged in thermal contact with the at least one cable core and the at least one cooling pipe, wherein the at least one heat conducting element is a heat conducting first metallic layer, and wherein the electric cable further comprises a heat conducting second metallic layer surrounding the at least one cooling pipe, and arranged in thermal contact with the at least one cooling pipe and the first metallic layer, the second metallic layer comprising a metal braid.

17. A high voltage electric cable comprising:

at least three cable cores, each surrounded by a first metallic layer, at least three cooling pipes comprising a polymer and adapted for carrying a cooling liquid, each cooling pipe surrounded by a second metallic layer, said three cooling pipes arranged in spaces formed between the three cable cores, a cable covering surrounding the at least three cable cores and at least three cooling pipes, said first metallic layers being in respective contact with said second metallic layers, and a fourth cooling pipe arranged in a space formed between the three cable cores in the center of the electric cable, and arranged in thermal contact with the first metallic layers.

* * * * *